United States Patent [19]

Lange

[11] 4,338,779

[45] Jul. 13, 1982

[54] APPARATUS FOR THE PRODUCTION OF ORNAMENTAL LINK CHAINS (VENETIAN CHAINS) READY FOR SOLDERING

[75] Inventor: Karl-Heinz Lange, Pforzheim, Fed. Rep. of Germany

[73] Assignee: FICO Fischer & Co. Maschinenbau GmbH, Pforzheim, Fed. Rep. of Germany

[21] Appl. No.: 220,012

[22] Filed: Dec. 23, 1980

Related U.S. Application Data

[62] Division of Ser. No. 75,023, Sep. 13, 1979.

[30] Foreign Application Priority Data

Sep. 13, 1978 [DE] Fed. Rep. of Germany ..... 2839746

[51] Int. Cl.[3] ..... B21L 11/00

[52] U.S. Cl. ..... 59/25; 59/27

[58] Field of Search ..... 59/12, 13, 16, 18, 19, 59/23–25, 27, 35 R

[56] References Cited

U.S. PATENT DOCUMENTS 1,886,194 11/1932 Kohm ..... 59/25

2,889,866 6/1959 Braun ..... 59/23 X

FOREIGN PATENT DOCUMENTS 1427360 4/1969 Fed. Rep. of Germany ..... 59/23

46-29006 8/1971 Japan ..... 59/19

*Primary Examiner*—Howard N. Goldberg

[57] ABSTRACT

An apparatus for producing ornamental link chains (Venetian chains). In accordance with the invention the cutting to length is followed by a conveying step transversely to a feed direction, both conveying steps are carried out transversely to a direction of action during the cutting to length, preliminary and finish bending (closing), the section of flat wire is held down for the preliminary bending and for the closing, the particular closed individual link is pushed into the extraction section to adjust the first transverse web in the assembly plane, and the striking is superimposed on the extraction of the chain.

8 Claims, 6 Drawing Figures

APPARATUS FOR THE PRODUCTION OF ORNAMENTAL LINK CHAINS (VENETIAN CHAINS) READY FOR SOLDERING

BACKGROUND OF THE INVENTION

This is a division of application Ser. No. 075,023, filed Sept. 13, 1979.

The invention relates to an apparatus for producing ornamental link chains (Venetian chains), method.

In general there are two requirements for ornamental link chains: they must be esthetically appealing and at the same time durable. The esthetic effect depends on the surface nature and the uniformity of the chain links. For Venetian chains, this means that with a precisely rectangular shape of the chain link, its visible surfaces must be completely plane. Moreover, since the human eye detects the slightest deviations in the arrangement of the chain formation, the internal dimensions must be precisely adhered to. Even minor deviations in the transverse play between interengaging chain links detract appreciably from the esthetic effect. The transverse play can be unified subsequently within limits by an intensified striking operation to which the chain is subjected. If the longitudinal arms of the chain links are rounded beyond the longitudinal axis, for example as a result of inadequate tool condition, so that the individual chain link deviates from the desired precise rectangular shape, planeness and parallelism between visible surfaces remote from one another, such condition can be achieved subsequently to a limited extent by a diamond operation which, in comparison with a common process to achieve a desired surface polish, is directed to a greater removal of material. Intensified hammering and shape-correcting diamond treatment as additional correctional measures increase the cost of the piece in a disadvantageous manner. The shape-correcting diamond treatment further leads—particularly with noble metals—not only to an appreciable loss of material by shaving waste, but also to the weakening of the thickness of the wire of the particular chain link, as a result of which the durability of the chain in question is adversely affected.

As already mentioned, a precise production depends to a great extent on the condition of the tools. The tools must be able to produce possibly extremely small dimensions of the flat wire and chain link. The tools are usually very very small and are subject to severe wear—even when being made out of a high quality of material. Consequently they have to be frequently reconditioned and replaced. This leads, in a disadvantageous manner, not only to high tool costs but also to inevitable down-time of the machines in question. In view of the necessary mass production to cover a large output demand, high costs of individual pieces cannot be tolerated.

According to the prior art, a process for the prefabrication of the chain is followed by a process for bringing the chain into a condition ready for soldering. The Venetian chain is first prefabricated on a first apparatus and then is transferred to a second apparatus for carrying out a rhythmic striking operation for the preset adjustment of the minimum width of a butt-joint gap to receive solder between ends of the individual links to be connected by soldering. The separation of the manufacturing process in time and also in place because of the necessity for two apparatuses, proves expensive in a disadvantageous manner as is obvious.

Even the method of prefabricating the chain has disadvantages. Such method is explained immediately below in connection with an apparatus designated FVZ as well as a stamping apparatus designated FSCHL which are described in a catalog published by the assignee of this application in 1974, all of which are regarded as prior art by the applicant.

A flat wire is pulled in horizontally against a stop and cut to a predetermined length by lowering a cutting tool. A preliminary bending tool with one of its outside edges serves as a cutting tool. It is detachably secured in a tool holder which is adapted for travel up and down along a vertical guide axis transversely to the pulling-in direction of the flat wire. After cutting the wire to length, the section of flat wire is bent into a U over a pre-bending mandrel by means of the preliminary bending tool. The pre-bending mandrel has a rectangular cross-section. Its width corresponds to the sum of the lengths of the two axial arms and the first transverse web. As a result of the springing back of the two U-arms, an adequate surface friction results between the surface regions of the section of flat wire and the immediately adjacent surfaces of the preliminary bending tool. Thus the U is firmly held in the preliminary bending tool.

The pre-bending mandrel is now removed axially from the range of action of the preliminary bending tool, transversely to the feed direction of the flat wire, and a closing mandrel is freed. The width of the closing mandrel corresponds to the length of the first transverse web and consequently one side of the rectangle to be described by the individual link. A finish bending tool for closing the U to form the individual link is disposed above the preliminary bending tool, so that the second bending operation (closing) is completed by further lowering of the holder. In the course of this, the second bending mandrel rests on an upper end of a pair of holding pincers. The latter includes two gripping elements with adjacent contact surfaces disposed vertically. These have an upper terminal edge with a horizontal surface forming the upper end of the holding pincers in common. The gripping elements are adapted for deflection out of a basic position in order to increase a lateral spacing between the two contact surfaces. In the basic position, the spacing between the contact surfaces corresponds at least to the width of the flat wire. If the holder is now lowered further to complete the second bending operation, then the two axial arms are formed by bending at right angles in the transverse region of the U, the short arms of which approach one another with their free ends over a curved path until they form a mutual butt joint. The individual link closed in the manner described above now surrounds the closing mandrel, over its periphery in a region defined by the basics, position spacing between the two contact surfaces.

(If a plurality of individual links have already been prefabricated then the section of chain formed by them hangs with the last individual link closed on the second bending mandrel). A vertical central axis of the holding pincers is in alignment with the guide axis of the tool holder. The holding pincers are now turned, for example in a clockwise direction, through 90° about the central axis out of their supporting position for the second bending mandrel and the latter is lowered to a preset height between the contact surfaces. The gripping elements now take over the closed individual link in that they approach one another with their contact surfaces until they come into friction contact with the outer surface in question of the axial arm. The first transverse web of the individual link lies adjusted in an assembly plane. The second bending mandrel is displaced axially and is pulled out of the individual link. In order that the two short U-arms of the next individual link (they each form half of the second transverse web) may engage in the individual link adjusted in height, and can form a butt joint with their two ends on closing, the holding pincers are turned through 90° in counterclockwise direction and so again into their supporting position for the second bending mandrel during the second bending operation for finish bending (closing) the following individual link. The next intake of flat wire can only be effected when the tool holder has returned vertically upwards into its initial position for the cutting to length.

In the above-described method of prefabrication it proves a disadvantage that the method steps of cutting to length, preliminary bending and closing take place at different heights of a region extending round the vertical guide axis of the tool holder. As a result, this region is blocked for the duration of the method steps to be carried out on an individual link. It is a further disadvantage that the preliminary bending tool serves at the same time as a cutting tool for cutting to length the flat wire fed in and consequently is subjected to increased wear at one side. Because the closing tool is disposed rigidly immediately above the preliminary bending tool, no holding down means can be used during the preliminary bending for the region remaining between the two short U-arms. Consequently, the flat wire can slide round the two bending edges of the bending mandrel, and thus it is not stretched horizontally but forms an arc. As a result, the individual part is rounded in the region in question.

From the combined arrangement of preliminary bending and closing tool it follows that the individual parts must be very thin, which is appreciably at the expense of the bending strength and so frequently leads to irregularities in the individual link or to tool breakage. Since the parts in question must be cold tough, they are frequently produced individually by hand work from bandsaw steel, particularly at the cutting edge side of the preliminary bending tool. This proves extremely time-consuming and costly. It is a further disadvantage that the holding pincers have to be turned twice through 90° for each individual link, in the course of which the gripping elements must be controlled for their movement. According to the prior art, each method step for controlling the drive or actuating the individual components (feed device, tool holder, bending mandrels, holding pincers, etc.) has a preset section disposed on a cam. The cam usually extends, closed in itself, along a guide edge, for example the periphery, of at least one disc driven in rotation. As a result of the need for idle steps which are not directly effective in the process, the course of the process is extended in time and an additional expenditure for the apparatus is necessary.

Finally, as already mentioned, it is a disadvantage that in order to achieve the state of the chain in which it is suitable for soldering preparation, a further method step has to be carried out on a second apparatus to adjust the width of the gap of the butt joint. After the closing of the gap the two axial arms of the individual link can actually spring back. As a result, the width of the butt-joint gap cannot be adequately controlled, which may lead to rejects in the soldering of the chain. In addition, the parallelism of the outer surfaces is not assured. A springing back of the two axial arms is to be expected to a disturbing extent, particularly if the flat-wire material is comparatively resistant to bending. This is particularly the case with alloys with a low proportion of noble metal (for example gold). This difficulty becomes obvious with solid wire, particularly of small dimensions, so that costly soldering wire had to be used, which in turn requires special soldering to be used for venetian chains.

SUMMARY OF THE INVENTION

It is an object of the invention to provide an apparatus for manufacturing a venetian chain with which the drawbacks of the prior art are eliminated or mitigated. With the apparatus of the invention the venetian chain can be made with greater wall thickness and consequently bending-resistant and rigid in itself. The comparatively greater wall thickness of the links of the chain permits, inter alia, the use of hard metal further to reduce the wear and to improve tool life. Advantageously, according to the invention, comparatively thicker flat wires can also be processed precisely. From the greater thickness of flat wire possible there results a welcome, additional esthetic effect. Further advantages will be seen in the course of the further description. They include, in proportion of noble metal (for example gold). This difficulty becomes obvious with solid wire, particularly of small dimensions, to such an extent that hitherto expensive solder core wire had to be used which requires the use of expensive special solder for Venetian chains.

The object of the invention, in order to avoid the disadvantages outlined, is to provide an apparatus for producing Venetian chains ready for soldering preparation in a single method train.

This problem is solved by the method of the invention. In such method:

(a) the cutting to length is followed by a conveying step transversely to a feed direction,
(b) both conveying steps are carried out transversely to a direction of action during the cutting to length, preliminary and finish bending (closing),
(c) the section of flat wire is held down for the preliminary bending and for the closing,
(d) the particular closed individual link is pushed into the extraction section to adjust the first transverse web in the assembly plane and
(e) the striking is superimposed on the extraction of the chain.

The advantages associated with the invention are obvious from the posing of the problem. Worth particular mention is the fact that its own tool is reserved for each method step of cutting to length, of preliminary bending and finish bending (closing) in separate regions. The tool, now only adapted to a single method step, can be made with greater wall thickness and consequently bending resistant and rigid in itself. The comparatively greater wall thickness which is possible permits, inter alia, the use of hard metal further to reduce the wear and to improve tool life. Advantageously according to the invention, comparatively thicker flat wires can also be processed precisely. From the greater thickness of flat wire possible there results a welcome, additional esthetic effect. Further advantages will be seen in the course of the further description. They include, in particular, the possibility of producing Venetian chains in the so-called Figaro manner, as is known, for example in anchor and tank chains. By analogy with this, a Venetian chain is understood in which a preset number of like individual links is followed by an individual link with a comparatively greater length of the axial arms. By this means a particular esthetic effect can be achieved.

BRIEF DESCRIPTION OF THE DRAWINGS

The invention is explained in more detail below with reference to a preferred example of an embodiment of the apparatus illustrated largely diagrammatically in the drawings, which omit details of the apparatus which are unimportant for the invention.

In the DRAWINGS.

DETAILED DESCRIPTION

Figure 1:
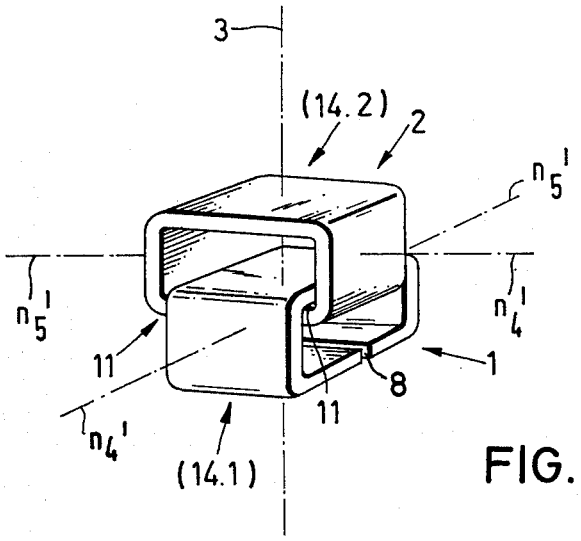
FIG. 1 shows part of a Venetian chain consisting of two individual links which are shown in perspective.
Figure 2:
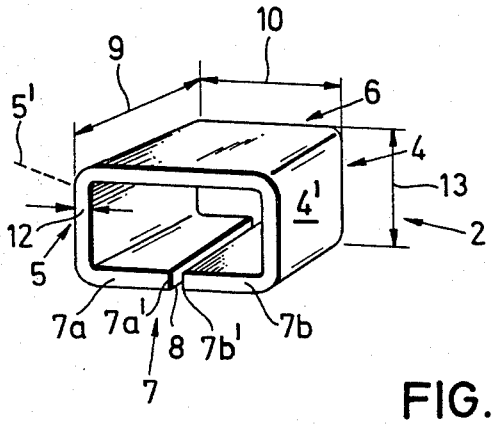
FIG. 2 shows an individual link of FIG. 1, also shown in perspective.

Turning now to FIG. 1, individual links 1 and 2 are shown, such links having been bent, respectively, at right angles from flat wire sections (14.1) and (14.2). The chain, which is not further illustrated, has a longitudinal axis 3, the links of the chain being interengaged perpendicularly in one another. Individual link 2 is shown in FIG. 2. Link 2 comprises two parallel, axial arms 4, 5 and a first web 6 and a second transverse web 7. The second transverse web 7 consists of two halves *7a, 7b,* which form a butt joint with a gap 8 with their free ends *7a', 7b'* in the middle of the web. The gap serves to receive solder before a soldering operation during which the two free ends *7a'* and *7b'* are connected to one another. In the transition between the two individual links 1 and 2 (FIG. 1) a length can be seen corresponding to four fillet regions 11 of two flat wire thicknesses 12 (FIG. 2), which are grouped along the longitudinal axis 3 of the chain with interruptions.

Figure 3:
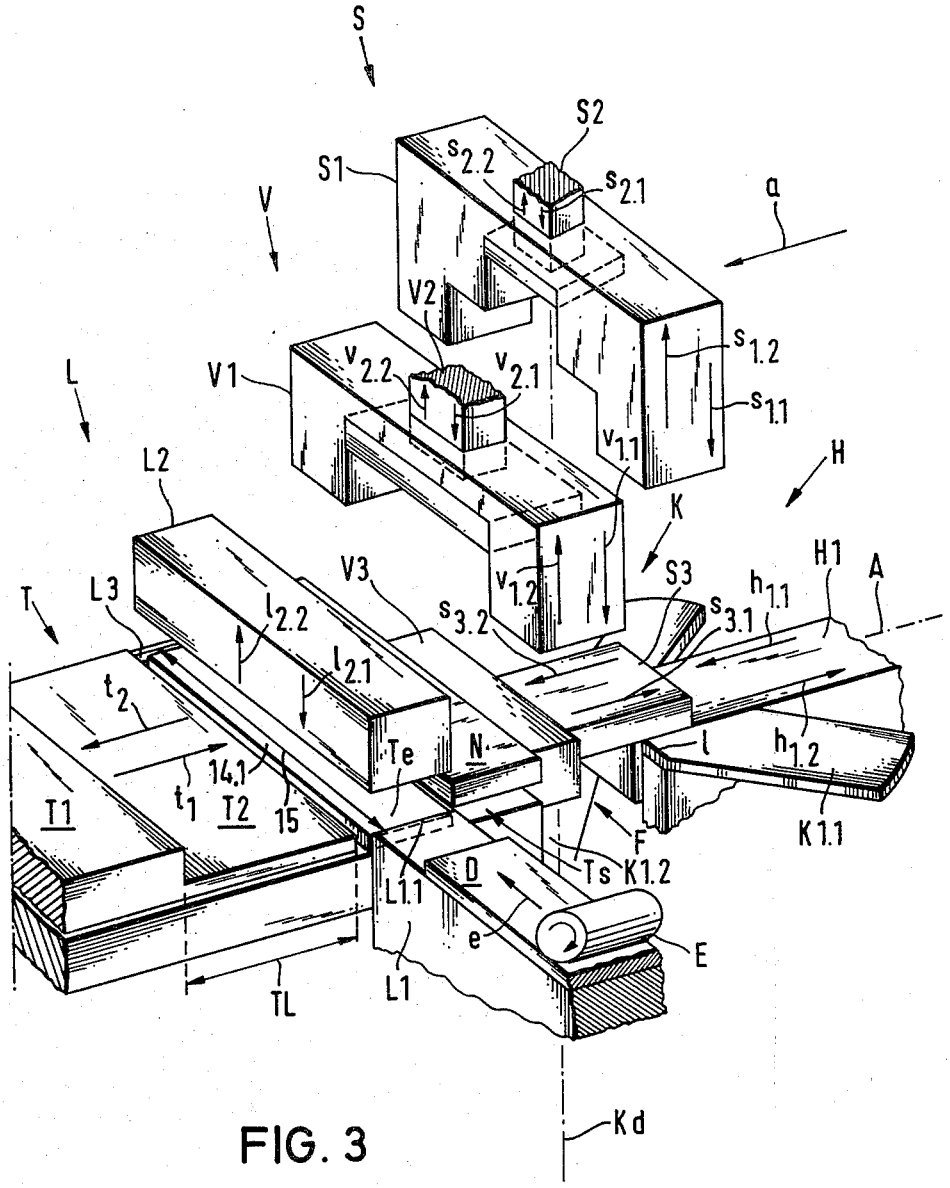
FIG. 3 shows an example of an embodiment of the apparatus according to the invention, such apparatus being illustrated in perspective, and diagrammatically simplified.

FIG. 3 shows an example of an embodiment of the apparatus according to the invention, illustrated in simplified form. Such apparatus comprises a conveying device T disposed along an axis A, a device L for cutting the wire to length, in the region of the latter a feed device E, which is only schematically indicated, a substantially stationary holding down means N, a preliminary bending device V, a closing device S, a diagonal tie K and a striking device H. A conveying plane Te extends from the region of the device L for cutting the wire to length into the closing device S. The conveying device T comprises a conveying slide T1, adapted for reciprocating movement at the upper side of the conveying plane Te, with a tongue T2. The cutting to length device L consists of a stationary lower knife L1, an upper knife L2 which can be lowered and raised and a stop L3.

Figure 4:
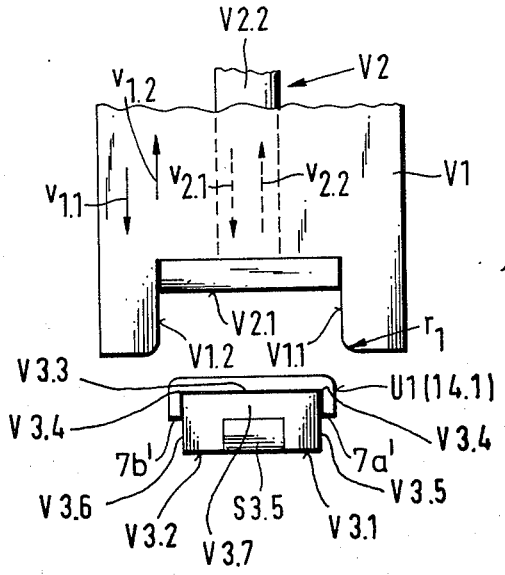
FIG. 4 shows a preliminary bending device in side elevation.

The upper knife L2 is made in block form in such a manner that it covers a section of flat wire 14 over its whole length 15 and consequently acts as a holding-down means at the same time. The holding down means N extends from the cutting to length device L to the preliminary bending device V and defines a conveying section Ts for the tongue T2 and a section of flat wire 14. The preliminary bending device V consists of an upper preliminary bending tool V1 for lowering and raising vertically, a holding down means V2 which can be lowered and raised vertically in the latter and a preliminary bending mandrel V3. The preliminary bending mandrel V3 has a U-shaped cross-section (FIG. 4) with a first arm V3.1 and a second arm V3.2, a horizontal surface V3.3 and a bending edge V3.4 between this surface and each flank V3.5 and V3.6. It serves as a guide for an axially movable closing mandrel S3. An outline at the under side of the upper bending tool V1 comprises two bending flanks V1.1, V1.2 adjacent to one another at the approximate distance of two arm lengths 13 plus the outside dimension 10 of the chain and two wire thicknesses 12 (FIG. 2), each being provided with an under edge radius $r_1$ (FIG. 4). At the top, the bending flanks V1.1 and V1.2 are connected to one another by an end face V2.1 of the holding down means V2. The upper preliminary bending tool V1 also comprises an axial guide which extends vertically and is not designated, for a shaft V2.2 of the holding down means V2.

Following the preliminary bending device V to the right in FIG. 3 is the closing device S. It consists of an upper closing tool S1 which can be lowered and raised vertically with a holding down means S2, which can likewise be lowered and raised.

Figure 5:
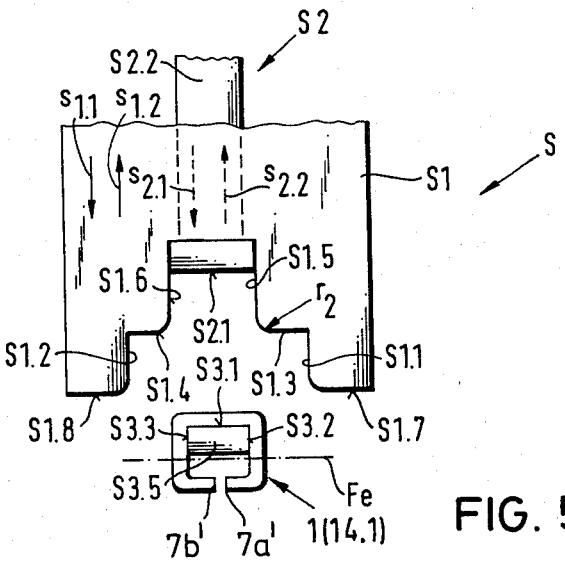
FIG. 5 shows a closing device in side elevation, seen in the direction of the arrow a in FIG. 3.

The width of an end face S2.1 of the holding down means S2 corresponds approximately to the outside dimension 10 of the links of the chain. An outline at the under side of the upper closing tool S1 comprises two vertical clamping flanks S1.1, S1.2 which are adjacent to one another at the approximate distance of two arm lengths 13 plus the outside dimension 10 of a chain and two wire thicknesses 12 and which merge into a horizontal clamping face S1.3, S1.4 (FIG. 5). The latter extend towards the middle and merge at a preset radius $r_2$ into two vertical closing flanks S1.5, S1.6 which are adjacent to one another at the spacing of the outside dimension 10 of the chain plus two flat-wire thicknesses 12. A horizontal connection of the closing flanks S1.5 and S1.6 at the top is formed by an under end face S2.1 of the holding down means S2. Horizontal dipping surfaces S1.7, S1.8 abutting on the clamping flanks S1.1 and S1.2 form the termination of the upper closing tool S1 at the under side.

In the closed position, the closing mandrel S3 can travel with a free end S3.5 in relation to the end face of the preliminary bending mandrel V3.7 into the outline of the upper closing tool S1 at the under side.

Figure 6:
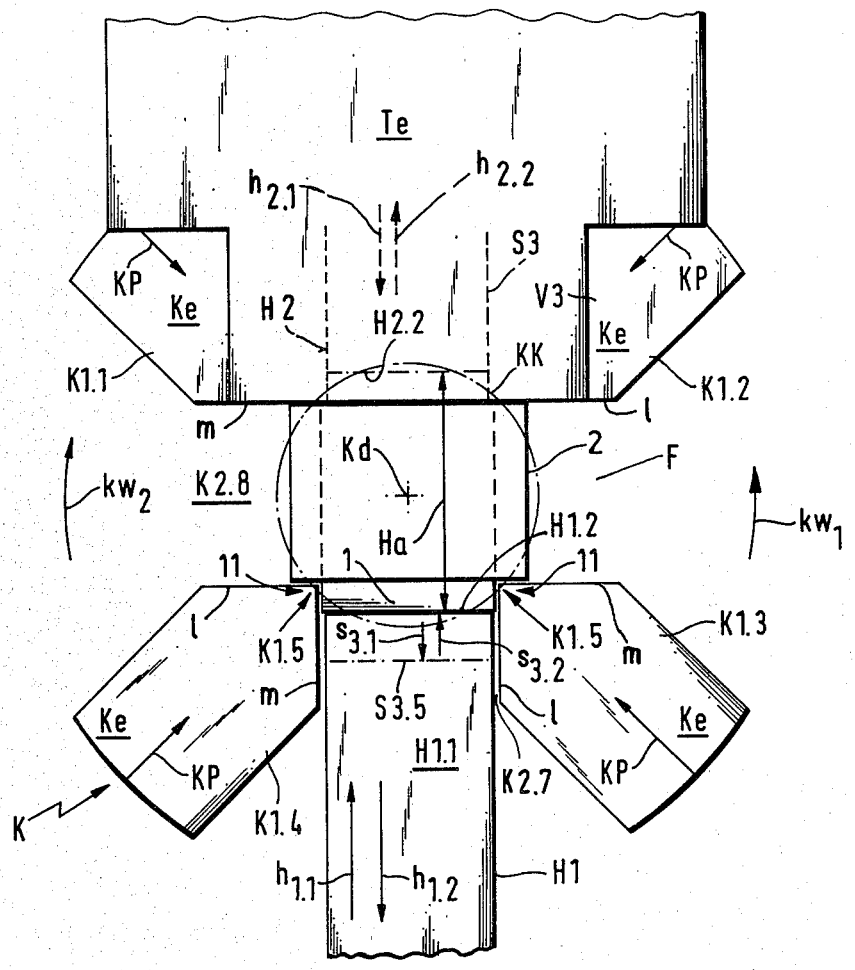
FIG. 6 shows a part of a diagonal tie and a striking device of the apparatus of FIG. 3 in plan view, such device being illustrated on a comparatively larger scale.

The diagonal tie K (FIG. 3) is adapted for rotation about a vertical central axis Kd (FIG. 6). It comprises, in a central region, contact surface prisms K1.5 aligned in relation to the central axis Kd of four gripping elements K1.1, K1.2, K1.3 and K1.4. The contact surface prisms K1.5, disposed in a circle KK, form an outer boundary of an extraction section F, the vertical axis of which coincides with the central axis of rotation Kd, and traverses the horizontal axis A. The gripping elements K1.1 . . . K1.4 are each adapted for resilient deflection against a centrally directed restoring force KP. An upper termination of the diagonal tie K is formed by a plane Ke of the four gripping elements K1.1 . . . K1.4. Two dipping gaps K2.7, K2.8 between the horizontal boundaries cross one another at 90°. Extending under the plane Ke parallel to the axis A are two striking beams H1 and H2 of the striking device H. Vertical end faces of the striking beams H1, H2, constructed in the form of peens H1.2, H2.2 are adjacent to one another with spacing and are directed towards the extraction section F. The two striking beams H1, H2, with their peens H1.2, H2.2 are adapted for movement towards and away from one another. The movement is effected through a known reversing drive, not illustrated. A minimum spacing Ha between the two peens H1.2, H2.2 is adjustable to the particular outside dimension 10 of the chain.

MANNER OF OPERATION

A section D of a flat wire 14 of the width 9 and the thickness 12 is fed in the direction of an arrow e transversely to a feed direction $t_1$ (FIG. 3) of the conveying slide T1 by means of the feed device E as far as the stop L3 and runs over a cutting edge L1.1 of the stationary lower knife L1. The upper knife L2, which is constructed in the form of a cutting block, is lowered in the direction of an arrow l2.1, as a result of which a first section 16.1 (FIG. 1) of flat wire of a preset length 15 is cut to length and then raised again in the direction of an arrow l2.2. The conveying slide T1 executes a stroke TL in the direction of the arrow $t_1$ (stroke direction). As a result, the first section 14.1 of flat wire is pushed by the tongue T2 along the conveying section Ts under the holding down means N, which is adapted for adjustment in height above the conveying plane Te at the distance of the thickness 12 of the flat wire. These operations are repeated rhythmically, and the first section 14.1 of flat wire comes to lie on the preliminary bending mandrel V3 in the region of the preliminary bending device V. The holding down means V2, which can be lowered and raised in the direction of the arrows in the upper preliminary bending tool V1 is lowered and presses the first section of flat wire 14.1 with a central portion firmly against its support formed by the upper surface V3.3 of the preliminary bending mandrel V3. The lowering movement of the holding down means V2 is followed directly by a lowering of the upper preliminary bending tool V1. As a result, two short arms 7*a*, 7*b* are bent as right angles on the first section 14.1 of flat wire, so that a flat U is formed (see FIG. 4). The upper preliminary bending tool V1 is raised again in the direction of the arrow $v_{2.2}$ while the holding down means V2 still loosely holds the U bent out of the section 14.1 of flat wire.

Section 14.1 is conveyed further by the following section of the flat wire (not illustrated) by a distance corresponding to the width 9 of the flat wire into the lower outline of the closing device S. There it travels in the direction of the arrow $s_{3.1}$ onto the upper surface of the closing mandrel S3 which is associated with the closing device S and has travelled out to the right in FIG. 3, and which is supported by its underside, not designated in detail, on an upper surface H1.1 (in the plane He) of the striking beam H1. The outer surfaces of the short U-arms 7*a*, 7*b* come into contact with the clamping flanks S1.1 and S1.2 and are held thereby. A holding down means S2 which can be lowered and raised in the direction of the arrows $s_{2.1}$,$s_{2.2}$ in the upper closing tool S1, is lowered and presses the U in a region corresponding to the first transverse web 6 firmly against a support formed by the surface S3.1. The lowering movement of the holding down means S2 is followed immediately by a lowering of the upper closing tool S1, which comes with its lower dipping surfaces S1.7 and S1.8 into the penetration gap K2.8. As a result, the two axial arms 4 and 5 are bent at right angles, and the two short U-arms 7*a* and 7*b* form the second transverse web 7 with a butt joint 8 between their free ends 7*a*', 7*b*'. The individual link 1 is closed and engages round the cross-section of the closing mandrel S3. As a result of a springing back force, the axial arms 4 and 5 remain in frictional contact, over their outer surfaces 4' and 5' with the closing flanks S1.5, S1.6.

The individual link 1 must now be positioned for the mounting of the following individual link 2. For this purpose, the closing mandrel S3 is first displaced to the left in the direction of arrow $s_{3.2}$ in FIG. 3. The holding down means S2 is lowered by a further preset distance in the direction of the arrow $s_{2.1}$ and pushes the individual link 1 into the extraction section F defined by the gripping elements K1.1 . . . K1.4, abandoning the frictional contact of the outer surfaces 4' and 5' with the closing flanks S1.5 and S1.6. The gripping elements K1.1 . . . K1.4 are so adjusted that, as a result of their resilient restoring capacity they ensure adequate frictional contact for the individual link 1 over the width 9 of the wire, and the first transverse web 6 is fixed in an assembly plane Fe (see FIG. 5) after the stuffing movement. The upper closing tool S1 and the holding down means (stuffer) S2 are lifted and the diagonal tie K is turned through 90° in the direction of an arrow $kw_2$ about its central axis Kd. The individual link 1 is now in the assembly position for the following individual link 2, and surface normals n4', n5' of the outer surfaces 4' and 5' and the axis A as well as the surface normals of the peens H1.2 and H2.2 are aligned parallel. The striking beams H1 and H2 are moved towards one another along direction arrows $h_{1.1}$, $h_{2.1}$ in such a manner that the peens H1.1 and H2.2 impinge on the adjacent outer surfaces 4',5'. By this means, the width of the gap 8 between the free ends 7*a*' and 7*b*' is adjusted against the spring restoring force of the link. The striking beams H1 and H2 remain in their position with the minimum distance Ha between their two peens H1.2 and H2.2 and fix the individual link 1 rigidly in the precise mounting position for the following individual link 2. In the meantime, in accordance with the description in connection with the individual link 1, the following individual link 2 is closed, and its halves 7*a* and 7*b* of the second transverse web 7 engage under the first transverse web 6 of the individual link 1 on engaging round the cross-section of the closing mandrel S3. In the course of this, the dipping surfaces S1.7, S1.8 enter the penetration gap K2.8. The striking beams H1 and H2 are again retracted into their initial positions. The closed individual link 2 is now pushed into the extraction section F and by turning the diagonal tie K in the direction of the arrow $kw_1$ through 90° positioned for the mounting of the following odd numbered individual link and is struck. This process is repeated, and a length of chain which is formed is aligned with the longitudinal axis 3 coaxially with the axis Kd by the engagement of the contact surface prisms K1.5 in the fillet regions 11, and is moved along the extraction section F in rhythm with the closing operation. The chain conveyed out is ready for soldering preparation. The soldering preparation is effected in known manner and therefore need not be described here.

From the above description it can be seen that a plurality of sections 14.1 . . . 14.n of flat wire are subjected substantially simultaneously to the successive method steps of cutting to length, preliminary bending, closing, striking and conveying away. From this there results a greatly increased discharge in comparison with the prior art described, and a transfer of the chain to a separate apparatus for the striking is made superfluous in an advantageous manner.

Furthermore, since the course of the process according to the invention does not have any idle steps, the control expenditure at the drive side can be kept comparatively low in an advantageous manner. The latter extends, inter alia, as mentioned in the introduction, to rotating cams for the coordinated actuation of the devices combined in the apparatus. The drive section is not considered essential to the invention and therefore its description and illustration are dispensed with.

The particular devices are adapted for easy exchange individually or in groups, to adapt the apparatus to production with different dimensions of flat wire and/or chain.

For the production of Venetian chains in the Figaro manner mentioned in the introduction, an additional apparatus working similarly to the one previously described must be provided, and in the assembly region there is a combination with a resulting modified extraction section.

Finally, the possibility may be emphasized of processing plates instead of or as well as sections of flat wire. They differ from the former by a cut in the marginal region, effected before the infeed, in a preset manner in order to achieve a particular esthetic effect. This possibility arises in view of a greater sensitivity of the plates to deformation in comparison with flat wire, from the presence of a holding down means in the upper preliminary bending tool and upper closing tool according to the invention and is not afforded in connection with the prior art described at the beginning. Such a Venetian chain may consist exclusively of individual links bent from plates. It is likewise possible, however, to connect individual links bent both from sections of flat wire and from plates in a predetermined alternating number and sequence to form an ornamental link chain.

Although the invention is illustrated and described in reference to one preferred embodiment thereof, it is to be expressly understood that it is in no way limited to the disclosure of such a preferred embodiment, but is capable of numerous modifications within the scope of the appended claims.

I claim:

1. In an improved apparatus for production of ornamental link chains ready for soldering preparation with individual links bent at right angles out of flat wire each with two axial arms and a first and a second transverse web, which comprises:

drawing in means for drawing a flat wire into the apparatus;

a cutting device for cutting the wire to length;

a preliminary bending device for bending the flat wire into a flat U with two short arms;

a conveyor device for conveying the flat U;

a bending means for finishing the flat U by bending to form an individual link such that the two short arms form the second transverse web with a butt-joint of their two free ends;

an adjusting means for adjusting the individual link in height while the first transverse web is disposed in a predetermined assembly plane;

a positioning means for detachably fixing the individual link and positioning the same for mounting of the following individual link which is now formed for the chain;

a conveying means for conveying the individual link along an extraction section;

a striking device for striking the chain to provide a preset adjustment of a minimum width of a gap to receive solder between the free ends;

the improvement comprising:

a first horizontal axis disposed in the plane of conveying of the conveyor device and along which axis are disposed the cutting device, the preliminary bending device, the conveyor device, the positioning means and the striking device which are separated from each other and along which the conveyor device and the striking device have their direction of action;

an upper knife movable in up-down direction and forming part of the cutting device;

a lower knife fixed in height and forming part of the cutting device;

an upper bending tool movable in up-down direction and forming part of the preliminary bending device;

a first holding down means movable in up-down direction and forming part of the preliminary bending device;

a lower preliminary bending mandrel fixed in height and forming part of the preliminary bending device;

an upper closing tool movable in up-down direction and forming part of the bending means;

a second holding down means movable in up-down direction and forming part of the bending means;

a lower closing mandrel fixed in height and forming part of the bending means and forming together with the upper closing tool and the second holding down means a closing device, said lower closing mandrel being movable in the direction of its longitudinal axis and parallel to the first horizontal axis;

a stopper device associated with the upper closing tool for adjusting the particular closed individual link in height;

a device constructed in the form of a diagonal tie rotatable around a second longitudinal axis and forming part of the positioning means and of the conveying means;

and four gripping elements each with a contact surface prism forming part of the device and disposed on an arc of a circle for deflection against a restoring force directed inwards toward the second longitudinal axis and defining with their contact surface prisms an upper portion of the extraction section, said extraction section traversing the first horizontal axis.

2. An apparatus as claimed in claim 1, wherein (a) the first holding down means in the upper preliminary bending device and the second holding down means are each adapted for movement vertically up and down along a longitudinal axis and (b) the first holding down means is constructed also to function as a stopper.

3. An apparatus as claimed in claim 1, wherein:

(a) the upper knife is of block-shaped construction in such a manner that it covers a section of flat wire over its whole length, (b) the preliminary bending mandrel of the preliminary bending device is constructed in the form of an axial guide for the closing mandrel, (c) the closing mandrel of the closing device is so constructed and arranged that it can travel in and out with a free end over an end face of the preliminary bending mandrel into and out of the working range of the upper closing tool, (d) the four gripping elements each are provided with a contact surface prism constructed in the form of a diagonal tie, the diagonal tie is bounded at the top by a plane which is formed by end faces of the gripping elements, (e) the end faces are separated from one another by gaps which with gaps of predetermined width form a right-angled isometric cross in the middle region of which the extraction section begins, (f) each of the two striking beams of the striking device are provided with peens, the striking beams are movable towards and away from one another and are directed with their peens towards the extraction section and each comprises a surface which lies in one plane at least in a region of the diagonal tie, (g) the preliminary bending mandrel is supported alternately on each of two adjacent end faces and (h) the bending mandrel, introduced into the working range of the upper closing tool, rests with its free end on the plane of the striking device.

4. An apparatus as claimed in claim 3, wherein an axial minimum spacing between the peens of the striking beams is adjustably variable.

5. An apparatus as claimed in claim 1, wherein the conveying plane extends from the region of the cutting to length device to the free end of the preliminary bending mandrel.

6. An apparatus as claimed in claim 1, wherein a holding down means through which a conveying section is formed along the first horizontal axis is disposed over the conveying plane between the cutting to length device and the preliminary bending device.

7. An apparatus as claimed in claim 1, wherein the conveyor device comprises a conveying slide oscillating rhythmically with a tongue.

8. An apparatus as claimed in claim 7, wherein the length of stroke of the conveying slide is adjustably variable.

* * * * *